United States Patent [19]

Gall

[11] 4,235,553

[45] Nov. 25, 1980

[54] MATERIAL MIXER

[75] Inventor: John C. Gall, Chicago, Ill.

[73] Assignee: Sears, Roebuck and Co., Chicago, Ill.

[21] Appl. No.: 58,034

[22] Filed: Jul. 16, 1979

Related U.S. Application Data

[63] Continuation-in-part of Ser. No. 945,544, Sep. 25, 1978, abandoned.

[51] Int. Cl.[3] ..... B01F 9/00

[52] U.S. Cl. ..... 366/208

[58] Field of Search ..... 366/208, 209, 213, 214, 366/217, 222–224, 232

[56] References Cited

U.S. PATENT DOCUMENTS

| | | | |
|---|---|---|---|
| Re. 21,973 | 12/1941 | Jorgenson . | |
| 1,855,909 | 4/1932 | Fisher . | |
| 1,908,561 | 5/1933 | Schletz et al. . | |
| 2,022,526 | 11/1935 | Schletz et al. . | |
| 2,022,527 | 11/1935 | Schletz et al. . | |
| 2,060,932 | 11/1936 | Friermood . | |
| 2,087,412 | 7/1937 | Nelson . | |
| 2,092,190 | 9/1937 | Taccogna . | |
| 2,118,362 | 5/1938 | Schletz . | |
| 2,190,487 | 2/1940 | Schletz . | |
| 2,206,669 | 7/1940 | Kowalski . | |
| 2,311,980 | 2/1943 | Dearborn . | |
| 2,323,403 | 7/1943 | Jorgenson . | |
| 2,527,556 | 10/1950 | Kost . | |
| 2,599,833 | 6/1952 | Holmlund . | |
| 2,610,041 | 9/1952 | Stahl | 366/215 |
| 2,797,902 | 8/1957 | Beugler . | |
| 2,846,201 | 8/1958 | Mermelstein . | |
| 2,894,309 | 7/1959 | Brzowski | 366/211 X |
| 2,901,805 | 9/1959 | Stahl et al. | 24/250 |
| 3,018,092 | 1/1962 | Johnson . | |
| 3,128,082 | 4/1964 | Cline . | |
| 3,181,841 | 5/1965 | Boehm | 366/211 |
| 3,265,366 | 8/1966 | Warner . | |
| 3,301,534 | 1/1967 | Orser . | |
| 3,346,241 | 10/1967 | Schubert . | |
| 3,388,895 | 6/1968 | Ogren et al. . | |
| 3,415,495 | 12/1968 | Grubelic . | |
| 3,464,675 | 9/1969 | Fabrize . | |
| 3,480,259 | 11/1969 | Schletz . | |
| 3,539,156 | 11/1970 | Zipperer et al. | 233/26 X |
| 3,542,344 | 11/1970 | Oberhauser | 366/202 |
| 3,552,723 | 1/1971 | Stefany | 366/202 |
| 3,693,943 | 9/1972 | Vester . | |
| 3,706,723 | 12/1972 | Oberhauser | 366/211 |
| 3,776,527 | 12/1973 | Cover et al. . | |
| 3,809,322 | 5/1974 | Hirosawa | 366/224 |
| 3,851,798 | 12/1974 | Miller | 222/135 |
| 3,880,408 | 4/1975 | Karjalainen | 366/217 |
| 3,885,357 | 5/1975 | Hoyt | 51/163 |
| 3,894,723 | 7/1975 | Sanders et al. | 416/238 X |
| 4,023,777 | 5/1977 | Kimmel | 366/223 |

FOREIGN PATENT DOCUMENTS

| | | | |
|---|---|---|---|
| 1387402 | 3/1975 | United Kingdom | 366/211 |

*Primary Examiner*—Leonard D. Christian

*Attorney, Agent, or Firm*—Arnstein, Gluck, Weitzenfeld & Minow

[57] ABSTRACT

A mixer for mixing flowable material in a container rotates the material continuously in one direction about a first axis and simultaneously about a second axis which is non-perpendicular to the first axis, the first axis rotating about the second axis. The mixer has means for supporting the container and for rotating the container simultaneously about the two axes. Desirable top to bottom circulation of material within the container is attained by the mixer of the present invention, while the apparatus is simplified and provides economies due to its lower speed and unidirectional, continuous rotational operation.

10 Claims, 11 Drawing Figures

MATERIAL MIXER

This is a continuation-in-part application of application Ser. No. 945,544, filed Sept. 25, 1978, and now abandoned.

FIELD OF THE INVENTION

The invention relates to a machine for mixing flowable material, and more particularly, to a machine for agitating and mixing material in a container, wherein the material may be liquid or partially liquid, such as two immiscible liquids or a liquid suspension, granular, or solid, such as gems, either alone or with granular material, for example an abrasive or the like surface finishing medium. The method and apparatus of the present invention will be hereinafter described in relation to a device for mixing a suspension such as paint, although it is understood that the invention is applicable for agitating, mixing, blending, tumbling, washing and the like as will be apparent to those skilled in the art.

BACKGROUND OF THE INVENTION

Mixing of various materials, for example paint, has heretofore been effected by manually mixing or agitating the material, such as by stirring or shaking, or by mechanically reproducing these activities. For example, U.S. Pat. No. 3,894,723 is directed to a mechanical agitator, while U.S. Pat. Nos. 1,908,561 and 3,265,366 are exemplary of patents disclosing paint shaking devices. The mixing action is relatively slow and inefficient in these devices. Material shaking devices, such as paint shakers, require substantial mechanical structure and a heavy base or anchoring since vibration is a major problem. Due to vibration and the force of the material on the lid of the container, cumbersome clamping apparatus must be employed to tightly retain the lid in position during the shaking operation. U.S. Pat. Nos. 2,599,833 and 2,894,309 teach clamping apparatus for use with containers in shaking devices.

Others have proposed mixing by accelerating material in a container first in one direction and then in the opposite direction to achieve mixing by the combination of shear forces and the creation and destruction of the vortex in the material. A mixer of this type is shown in U.S. Pat. No. 3,542,344. While a mixer of this type reduces the problems of vibration and eliminates the necessity to clamp the lid on the container, substantial power and braking apparatus are required to effect the acceleration and reversal of the material in the container. Another type of mixer spins the container in one direction and oscillates the container at the same time. An example of this type of device is disclosed in U.S. Pat. No. 3,181,841. This type of device also requires substantial mechanical structure, disadvantageously causes vibration and requires clamping of the lid or cover of the container. Still another type of mixing apparatus simultaneously spins a container of material about two perpendicular axes. U.S. Pat. No. 3,880,408 discloses a device in which the container is rotated continuously about the two axis, whereas U.S. Pat. No. 3,706,443 discloses apparatus which rotates the container continuously about one axis but only rocks about the second, perpendicular axis by gyroscopic forces due to imbalance in the system. While the resulting mixing action is relatively rapid, considerable mechanical structure, often requiring a gimbal arrangement is required and vibration and the necessity to clamp the lid to the container are still encountered.

Thus, various types of apparatus have been proposed to accomplish the mixing of material rapidly and efficiently, but none of the proposed or heretofore used devices have been able to accomplish this goal without requiring substantial mechanical structures, inordinate power consumption, and/or structure to overcome or lessen the effects of vibration and forces acting upon the lid of a container.

Therefore, there is a need for an improved material mixing device of relatively simple mechanical design which can attain efficient mixing action, including bottom-to-top mixing action with low power consumtion, with very little vibration and without the need to clamp the lid to the container.

SUMMARY OF THE INVENTION

An object of the invention, therefore, is the provision of an improved mixer of simplified mechanical design.

Another object of this invention is the provision of a mixer having efficient mixing action at relatively low rotational speed which reduces problems of vibration and balance.

Still another object of the present invention is to provide a mixer for material in a conventional container utilizing rotation of the container in a single direction, substantially about the center of gravity of the filled container with little or no vibration and without the necessity of clamping a lid on the container.

Further objects and advantages of this invention will become apparent from the following description when the same is considered in connection with the accompanying drawings.

In accordance with the present invention, there is provided a mixer for mixing at least partially flowable material within a container, which is perferably generally cylindrical, wherein the material in the container is rotated in one direction about a first axis and simultaneously rotated in the same direction about a second axis which is non-perpendicular to the first axis. In the mixer of the present invention, first supporting means is provided for supporting the container for rotation about the first axis and second supporting means is provided for supporting the container for rotation about the second axis. First drive means are included which is connected to the second supporting means for rotating the container about the second axis, and second drive means are similarly included which is connected to the first supporting means for rotating the container about the first axis. In the described relationship between the respective drive means and the axis, the first axis rotates about the second axis.

In rotating the container of material continuously in one direction simultaneously about two-non-perpendicular axes in non-orbital and non-oscillating, non-rocking motion, the mixer of the present invention achieves efficient mixing of the material within the container including a stirring or mixing of material from the top of the body of material in the container to the bottom as well as from the side of the body of material. By maintaining the two axes in non-oscillating and non-perpendicular position, and rotating the container unidirectionally and at constant angular velocity throughout the mixing cycle, the axes can be substantially, but need not be precisely about the center of gravity of the material in the container and a relatively low rotational speed can be employed. The resulting improved mixing action will thereby require only a low power requirement, simple mechanical structure using standard drive components, and will encounter little, if any, balance or vibration problems. Clamping of the container to the supporting means or of the lid to the container is unnecessary in the present invention, since the forces on both container and lid in the method of the present invention have been sufficiently reduced to eliminate these conventional requirements.

BRIEF DESCRIPTION OF PREFERRED EMBODIMENTS

Figure 1:
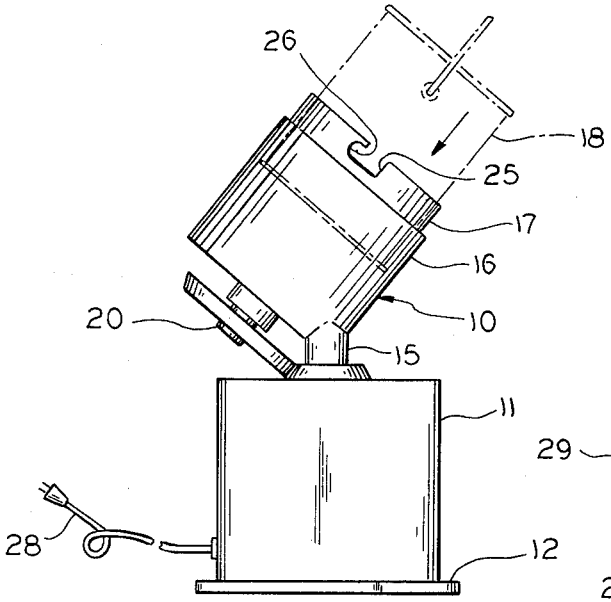
FIG. 1 is an elevational view of a mixer embodying the present invention, with a container being shown in broken lines being placed into the device.

In the particular construction shown in FIGS. 1–3 and 10 of the drawings, the numeral 10, indicates, generally, a mixer in accordance with the present invention. Mixer 10 includes a housing 11 secured to a base 12 on which is mounted a motor 13. A drive shaft 14 extends upwardly from motor 13 through the top of housing 11 and includes a portion 15 of larger diameter which is secured to and supports an outer holder 16. Outer holder 16 serves as second supporting means as will be hereinafter described. Positioned within outer holder 16 is an inner holder 17, which serves as first supporting means which will also be hereinafter described, and which is adapted to receive a container 18 containing the material to be mixed.

Outer holder 16 is generally cylindrical in shape and is integral with enlarged portion 15 of shaft 14 for rotation with the shaft about axis B—B by motor 13. Housing 11 includes suitable bearings, for example ball bearing assembly 19 to reduce friction between shaft 14 and housing 11. Motor 13 rotates drive shaft 14 and outer holder 16 in one direction, counterclockwise for the purpose of illustration.

Inner holder 17 is generally cylindrical and is secured at its bottom to a shaft 20 for rotation about axis A—A. Inner holder 17 is supported for rotation within outer holder 16 by suitable bearing material contacting its outer surface as at 21 and at the area where shaft 20 passes through the outer holder 16, as at 22. In the embodiment illustrated in FIG. 2, a disc 23 having a bevelled outer edge is secured to shaft 20 and is in rolling engagement with a mating bevelled surface 24 on housing 11 surrounding the opening for drive shaft 14. As shown, inner holder 17 extends beyond the upper, open top of outer holder 16 and is itself open to receive a generally cylindrical container 18. Inner holder 17 can include at least one notch 25 which may have a slot 26 adapted to engage a boss 27 of container 18 adapted to secure a handle or bail on the container. Inner holder 17 preferably includes a second notch and slot diametrically opposite notch 25, which is adapted to engage another boss of container 18.

In operation, a container 18 of material to be mixed, such as paint, is placed within inner holder 17 until its bottom rests upon the bottom of holder 17 and/or its boss 27 rests within notch 25 of holder 17. No clamping mechanism is required to hold a lid, such as cover 35 in FIG. 10, on container 18. As is conventional, cover 35 may have an annular depending lip 36 which engages an annular well 37 in an inwardly extending flange 38 when cover 35 is pressed onto the top of container 18. To activate mixer 10, power is provided to motor 13 as shown, by connecting power cord 28 to a suitable source of power. Motor 13 rotates shaft 14, its portion of larger diameter 15, outer holder 16 secured to portion 15, inner holder 17 and container 18 counterclockwise about axis B—B. Simultaneously, shaft 20 and disc 23 are moved counterclockwise about axis B—B due to shaft 20 being journalled in outer holder 16 at area 22 and shaft 20 being secured to inner holder 17 as the latter is rotated by outer holder 16. Shaft 20 and disc 23, whose center lies along axis A—A moves about axis B—B at an acute angle formed between the two axes when viewed as in FIG. 2. Since disc 23 is in rolling engagement with bevelled surface 24 of housing 11, disc 23 and hence shaft 20 to which it is secured, rotate about axis A—A due to the disc being driven about axis B—B at the described angle between the axes while its outer surface is in rolling engagement with surface 24. The movement of disc 23 and its rolling engagement imparts rotation to the disc and shaft 20 which in turn causes rotation of inner holder 17, which is secured to shaft 20, and to container 18. Upon initial rotation of container 18 about axis A—A, slot 26 bears against boss 27 of container 18, causing positive locking engagement between outer holder 17 and container 18.

Figure 2:
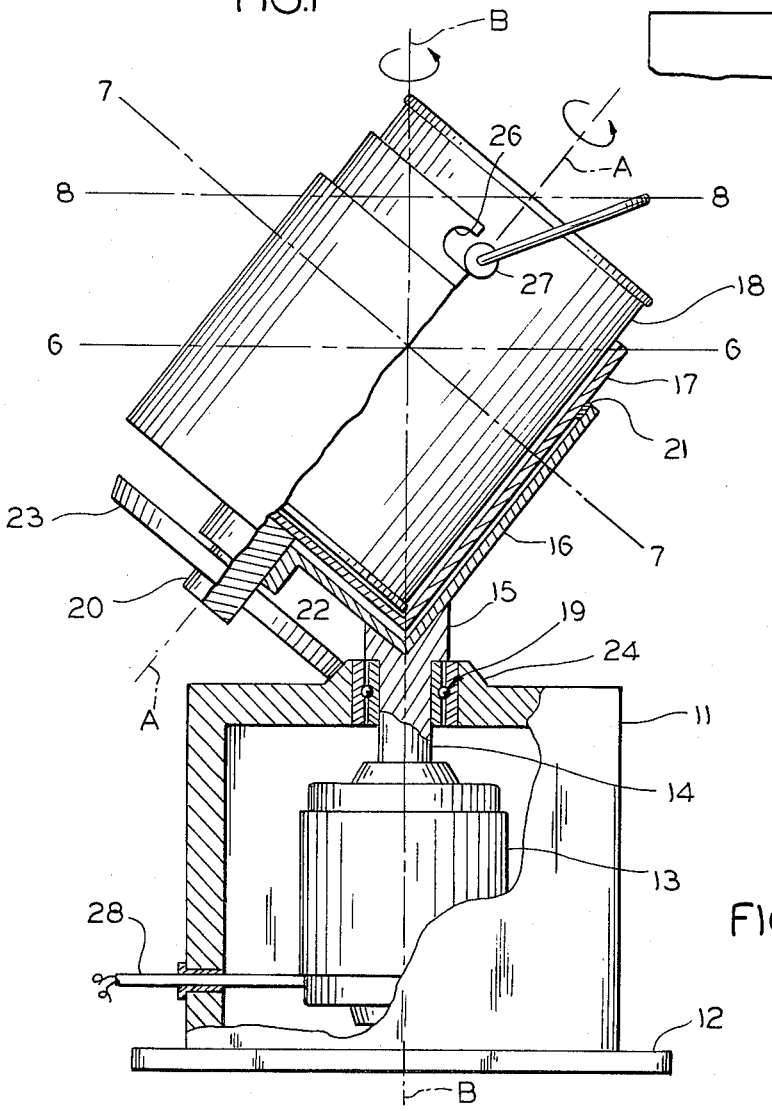
FIG. 2 is a partially cross-sectional, elevational view of one embodiment of the mixer shown in FIG. 1.

In this manner, container 18 and the material therein to be mixed, are rotated simultaneously about a first axis A—A and about a second axis B—B in the same direction, the two axes being non-perpendicular to each other, i.e., at an acute angle to each other when viewed as in FIG. 2, with the first axis A—A rotating about the second axis B—B. Preferably axes A—A and B—B intersect or appear to intersect (as in FIG. 4) with each other within the space defined by container 18. It will be seen that container 18 has been placed in inner holder 17 which serves as first supporting means for supporting container 18 for rotation about first axis A—A and that outer holder 16 acts as second supporting means for supporting container 18 for rotation about second axis B—B; and that motor 13 and drive shaft 14 act as first drive means connected to outer holder 16 for rotating container 18 about second axis B—B and that disc 23 and shaft 20 connected to inner holder 17 act as second drive means for rotating container 18 about first axis A—A. It will be further seen that outer holder 16 supports inner holder 17 and at least a portion of the second drive means, i.e. shaft 20 and disc 23 for rotation about second axis B—B, and that the drive means rotate the respective supporting means in the same direction. First axis A—A precesses second axis B—B about which container 18 and its contents are rotated.

Figure 5:
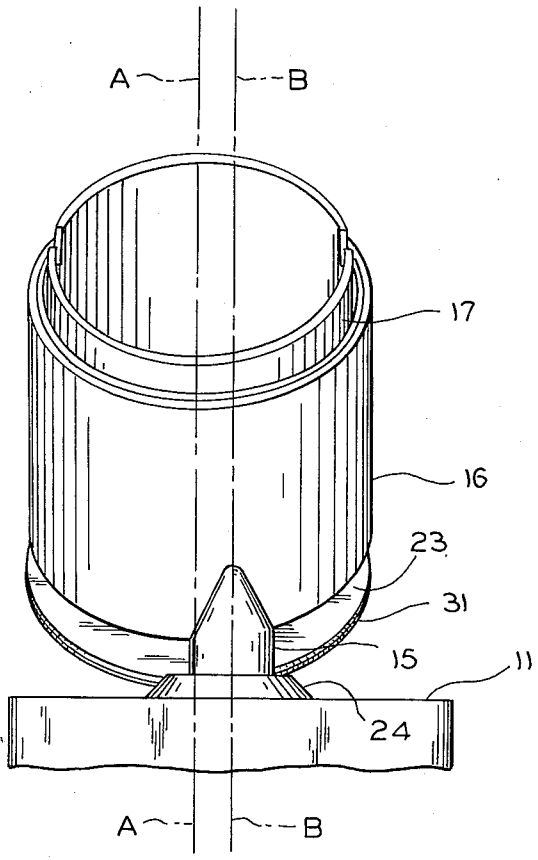
FIG. 5 is a right side view of the mixer shown in FIG. 4 at the position there-shown.
Figure 4:
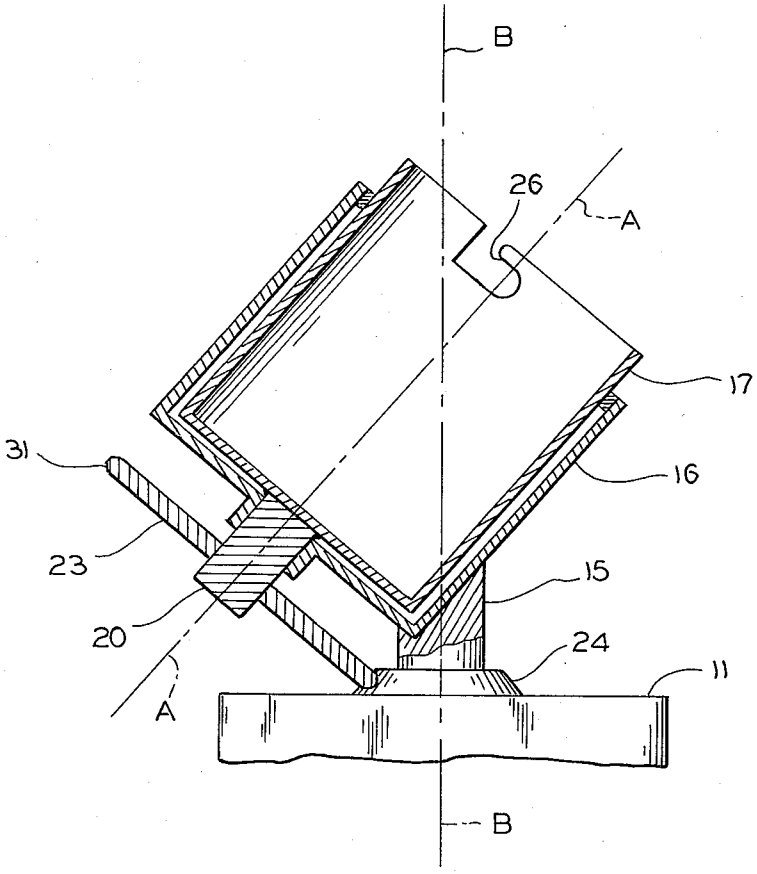
FIG. 4 is a cross-sectional, elevational view of still another embodiment of the mixer of the present invention.

In the particular embodiment thus described, first axis A—A is substantially congruent with the axis of the generally cylindrical container 18 and second axis B—B intersects successive points of intersection of the bottom and generally cylindrical side of container 18 so that the material within the container is rotated about the two axes which are substantially at the center of gravity of the container and of the apparatus. Axes A—A and B—B may be offset from each other, as shown in FIGS. 4 and 5, by a small amount, for example, up to approximately ½ inch, although a smaller offset, in the order of up to ⅛ to ¼ inch is preferred if an offset is to be employed. Rotation about these axes, whether offset or not, provides efficient and thorough mixing of the material with a minimum of the vibration and balance problems which would be otherwise encountered.

Figure 3:
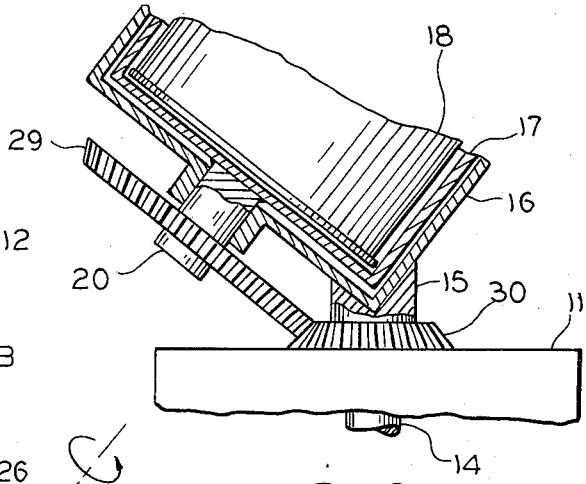
FIG. 3 is a fragmentary, partially cross-sectional, elevational view of another embodiment of the mixer shown in FIG. 1.

In the embodiment shown in FIG. 3, a positive, rather than a frictional drive, is provided to inner holder 17 by replacing the bevelled surface of disc 23 and surface 24 with engaging bevelled gears 29 and 30, respectively. The use of gears 29 and 30 provide the same operation as in the embodiment illustrated in FIG. 2, with the elimination of slippage which can be caused by the presence of paint or other material reaching the bevelled surface of disc 23 or surface 24.

In the embodiment shown in FIGS. 4 and 5, the axes A—A and B—B are offset from each other a small amount, although as viewed in FIG. 4 they appear to be at an acute angle to each other. As illustrated, axis A—A passes through the center line of container 18, but axis B—B is offset from the line described in connection with the embodiments shown in FIGS. 1-3. In this embodiment axis B—B does not intersect successive points of intersection of the bottom and side of container 18, but only successive points on a circumference of the side of the container. The offset of the axes can clearly be seen in FIG. 5, which also illustrates that the axes do not intersect in fact, as they do in the embodiments in FIGS. 1-3, but appear to intersect when viewed at a right angle, as in FIG. 4.

The same reference numerals have been used in FIGS. 4 and 5, as in FIGS. 1-2, since almost all of the elements are identical or substantially identical. However, since disc 23, rotating about axis A—A is offset with respect to axis B—B, disc 23 is shown with a rounded edge 31, rather than a bevelled edge to facilitate its point-to-point rolling contact with surface 24 and to allow for slippage due to the skew between edge 31 and surface 24.

Figure 6:
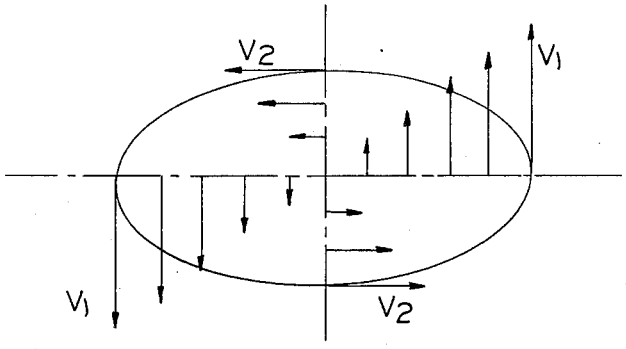
FIG. 6 is a diagramatic representation of the velocity distribution of the material in the mixer of the present invention as taken in a plane transverse to the container of the material taken along line 6—6 of FIG. 2.

FIGS. 6-9 illustrate the theory of operation which is believed to take place in accordance with the method and apparatus of the present invention. The figures illustrate the velocity distribution taking place within the material in container 18 during operation. FIG. 6 illustrates the velocity distribution upon a section being taken perpendicular to axis B—B through the material at line 6—6 of FIG. 2. The maximum velocity $V_1$ and the minimum velocity $V_2$ applied to the surface of the material adjacent to the side wall of container 18, and the interior arrows represent the internal velocities as one moves toward the center of container 18. These internal velocities indicate the maximum potential velocities if the entire mass were rotated at uniform rotational speed. This condition is assumed for the sake of explanation and is not attained in actual operation.

Figure 7:
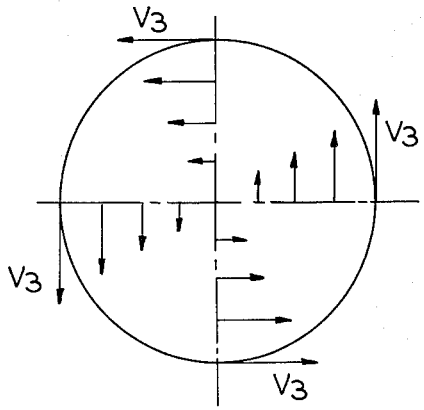
FIG. 7 is a representation identical to FIG. 6 taken along line 7—7 of FIG. 2.
Figure 8:
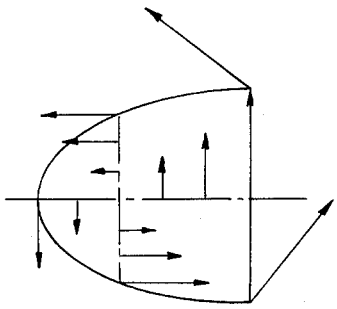
FIG. 8 is a partial diagramatic representation of the velocity distribution of the material in the mixer as taken in a plane transverse to the container of the material along line 8—8 of FIG. 2.
Figure 9:
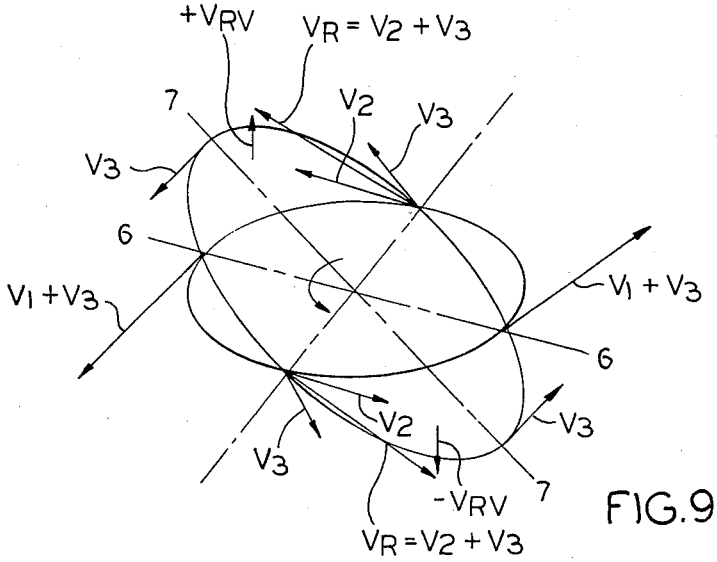
FIG. 9 is a composite of the velocity distribution as represented in FIGS. 6–7.
Figure 10:
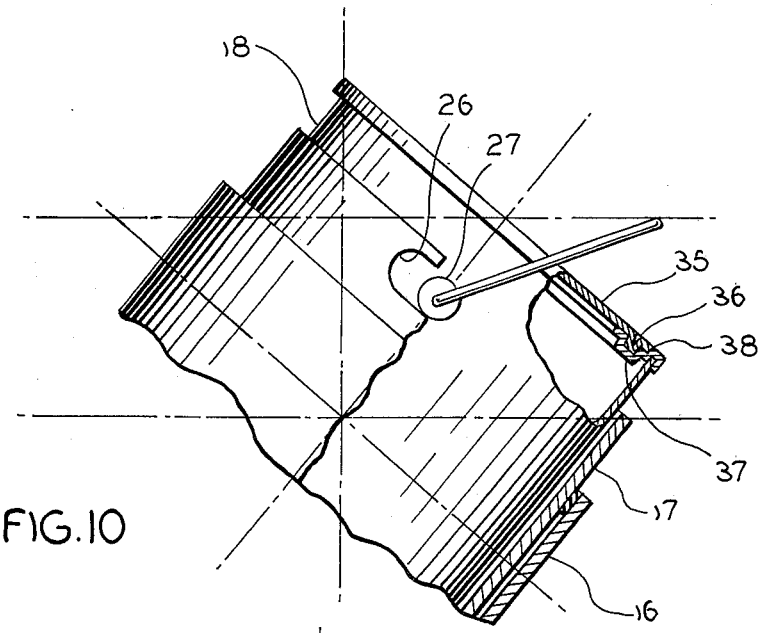
FIG. 10 is a fragmentary, partially cross-sectional, elevational view of a mixer as shown in FIG. 1.

FIG. 7 illustrates the velocity distribution at a section of the material taken perpendicular to the axis A—A taken along line 7—7 of FIG. 2. The velocity attained is caused by the rotation about axis A—A with the maximum velocity $V_3$ of the material adjacent to the wall of container 18. This potential velocity distribution would apply to any plane perpendicular to axis A—A due to the shape of container 18. In actual operation, both velocity distributions illustrated in FIGS. 6 and 7 are occurring simultaneously with the velocity vectors at any particular point within container 18 being additive. As an example, in FIG. 9 the outer portions of section 6—6 would have a total velocity of $V_1$ plus $V_3$ in a horizontal plane, while at the perpendicular to these outer portions the resulting velocity $V_R$ is the result of the vector addition of $V_2$ plus $V_3$, as illustrated. The vectoral total velocity ($V_1$ plus $V_3$) and the resulting velocity $V_R$ will be at an angle to plane 6—6 due to the angular displacement of the sections 6—6 and 7—7. It will be noted that a vertical component $V_{RV}$ is established which is positive on one side of the container and negative on the opposite side of the container. The summation of the vertical components $V_{RV}$ causes a circulation in container 18 from the bottom of the material to the top. It can be seen that the changes in velocity in the horizontal plane and the vertical circulation will successively expose all of the material to velocities ranging from 0 at the center, which will be greater than 0 if the axes are offset as in FIGS. 4 and 5, to a maximum of $V_1$ plus $V_3$. Maximum velocity difference within the material also occurs with axes A—A and B—B intersecting or apparently intersecting (FIG. 4) within the space defined by container 18, whereas substantially less velocity difference is obtained where the axes do not intersect, or do not appear to intersect when viewed at a right angle, within the container. In addition, the non-uniform sections, such as illustrated in FIG. 8, which is taken along a line 8—8 in FIG. 2 has a velocity distribution which will cause relatively more severe velocity changes or turbulence than will be present at uniform sections of the material. Again, all material will be exposed to all of the velocity patterns. These changes in velocity provide the shear necessary for mixing and are provided in a smooth and continuous manner without violent agitation which can be detrimental to some materials.

Figure 11:
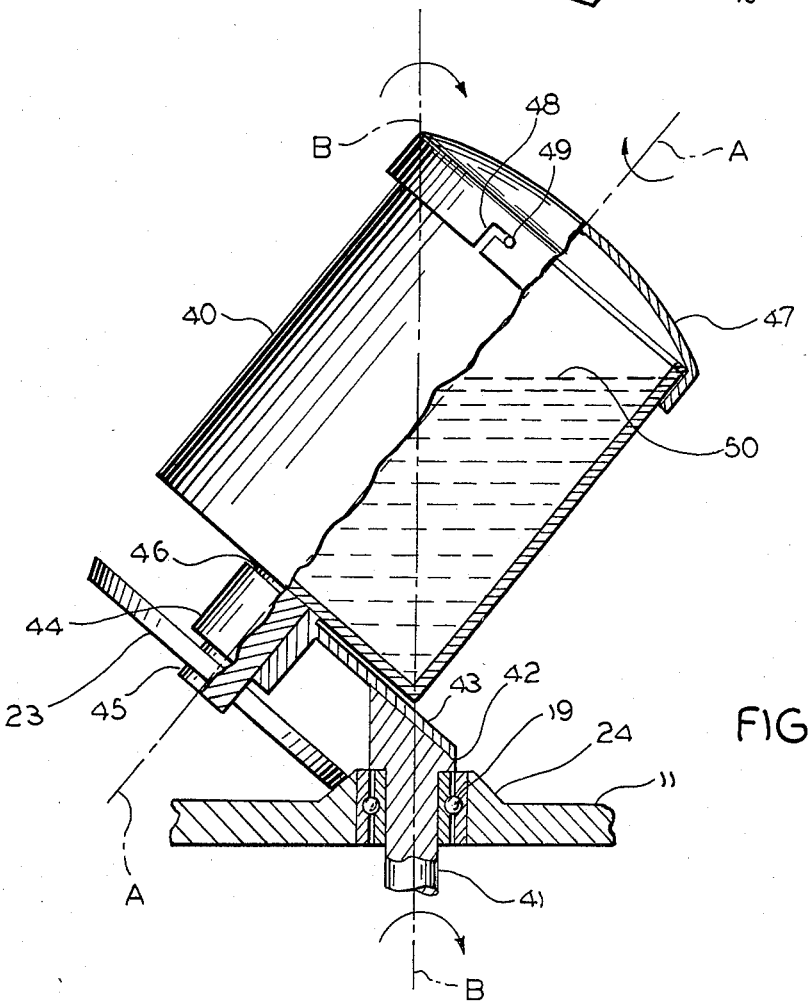
FIG. 11 is a fragmentary, partially cross-sectional, elevational view of another embodiment of a mixer in accordance with the present invention.

In still another embodiment, illustrated in FIG. 11, mixing in a container 40 is provided where it is desired to mix in bulk or in a container other than a conventional container, such as container 18 in FIGS. 1-5 and 10. In this embodiment, a drive shaft 41 extends through a housing which may be identical to the housing 11, and extends from a motor (not shown) which may be identical to motor 13 as in FIGS. 1 and 2. Similar reference numerals are utilized in FIG. 11 to identify common elements described in connection with the embodiment of FIGS. 1 and 2, and the description of these elements is incorporated herein. Drive shaft 41 includes a portion 42 of larger diameter which is secured to and supports a crank member 43. The opposite end of a crank member 43 supports, and is preferably integral with, a bearing member 44 in which a shaft 45 is rotatably journalled. Bearing member 44 at its upper end has an upwardly projecting portion 46 which rotatably supports the bottom of container 40, which in turn is secured to shaft 45 and is rotated thereby. As in the embodiment shown in FIG. 2, a disc 23 having a bevelled outer edge is secured to shaft 45 and is in rolling engagement with a mating bevelled surface 24 on housing 11. Alternatively, the engaging gear arrangement illustrated in FIG. 3 can be employed. A cap or lid 47 is provided to close container 40. Cap 47 optionally can have a pair of angled slots 48, each cut into opposite sides of its rim, which are adapted to engage a pair of pins 49 secured to opposite sides of container 40 to releasably lock cap 47 to the container.

In the use of the mixer shown in FIG. 11, material to be mixed, such as a liquid 50, is placed into container 40, up to a desired level, for example up to the lowest portion of the top of the container. Additional material can also be added by initially tilting the mixer to the left so that container 40 is substantially upright. Cap 47 is positioned and locked in place by twisting the cap to seat pins 49 in slots 48. Power is provided to the motor which rotates shaft 41, crank member 43, bearing member 44, container 40 and shaft 45 about axis B—B. Simultaneously, due to shaft 45 being rotated about axis B—B with disc 23 in rolling engagement with bevelled surface 24, disc 23 and shaft 45, and hence container 40 secured to shaft 45, are rotated about axis A—A. In this manner material 50 and container 40 are rotated simultaneously and continuously about first axis A—A and about second axis B—B in the same direction in a non-orbital, non-oscillating movement, with the two axes being non-perpendicular to each other, i.e. at an acute angle to each other when viewed as in FIG. 11, and intersecting within the space defined by container 40.

In this embodiment, shaft 45 to which container 40 is secured, and the upwardly projecting portion 46 of bearing member 44 which rotatably supports the bottom of container 40, serve as first supporting means for supporting container 40 for rotation about first axis A—A; and crank member 43 and bearing member 44, and also the latter's upwardly projecting portion 46, serve as second supporting means for supporting container 40 for rotation about second axis B—B. The motor, which is not shown in FIG. 11, and drive shaft 41 connected to crank member 43 serve as first drive means for rotating container 40 about second axis B—B; while disc 23 to which shaft 45 is connected serves as second drive means for rotating container 40 about first axis A—A. Thus, while container 40 is being rotated about second axis B—B by the first drive means, it simultaneously is being rotated about first axis A—A by the second drive means.

As described, the method of mixing and the mixer of the present invention provides efficient and thorough mixing with circulation both from the sides of the container, as well as from the top to the bottom of the material in the container. Moreover, the invention can be practiced utilizing standard drive components assembled in a simplified construction. Operation of the mixer is accomplished at lower cost and with less maintenance than in previously disclosed devices, in view of the operation at low rotational speeds, continuously in one direction. Braking devices, reversing mechanisms and oscillating mechanisms used in previously disclosed mixers have all been eliminated, contributing to the longer operating life with reduced cost and maintenance of the mixer of the present invention.

Various changes coming within the spirit of the invention may suggest themselves to those skilled in the art; hence the invention is not limited to the specific embodiment shown or described and uses mentioned, but the same is intended to be merely exemplary, the scope of the invention being limited only by the appended claims.

I claim:

1. Apparatus for mixing flowable material within a container comprising:

A. first supporting means for supporting the container for rotation in one direction about a first axis;

B. second supporting means for supporting the container for rotation in said one direction about a second axis which is non-perpendicular to the first axis;

C. first drive means connected to said second supporting means for rotating the container in said one direction about said second axis; and D. second drive means connected to said first supporting means for rotating the container in said one direction about said first axis while the container rotates about said second axis.

2. The apparatus as defined in claim 1, wherein said second supporting means further supports said first supporting means and at least a portion of said second drive means for rotation about said second axis, said second drive means thereby rotating said first supporting means about said second axis.

3. Apparatus as defined in claim 2, wherein said first and second drive means rotate the respective supporting means in the same direction and said first axis precesses said second axis.

4. Apparatus as defined in claim 3, wherein the container and said first and second supporting means are each substantially cylindrical and positioned so that the container and said first supporting means are rotated by said second drive means about said first axis and simultaneously the container and said first and second supporting means are rotated by said first drive means about said second axis.

5. Apparatus as defined in claim 1, wherein said first and second supporting means are each substantially cylindrical and said first drive means includes a first shaft which is affixed to and supports said second supporting means for rotation of said first and second supporting means about their respective axes.

6. Apparatus as defined in claim 5, wherein said first shaft rotates within a non-rotating member and said second drive means includes a second shaft journalled in said second supporting means and connected to said first supporting means and to rotational means which engages said non-rotating member for rotating said second shaft and said first supporting means, whereby rotation of said first shaft by said first drive means causes rotation of said first and second supporting means about said second axis and simultaneously causes rotation of said first supporting means about said first axis through said second shaft being rotated by said rotational means rolling about said first shaft while in contact with said non-rotating member.

7. A method of mixing at least partially flowable material in a container comprising continuously, non-orbitally rotating the container in one direction about a first axis and simultaneously rotating the container in the same direction about a second axis which is non-perpendicular to the first axis, said first axis non-orbitally rotating about said second axis.

8. The method as defined in claim 7, wherein said first axis is substantially congruent with the axis of the container which is generally cylindrical, so that the material is rotated about said axis passing through the axis of the container.

9. The method as defined in claim 7, wherein said first axis precesses said second axis.

10. The method as defined in claim 7, wherein said second axis intersects successive points of intersection of the bottom and generally cylindrical side of the container of at least partially flowable material, so that the material is rotated about said axis passing through said intersection.

* * * * *

REEXAMINATION CERTIFICATE (1443rd)

United States Patent [19] [11] B1 4,235,553

Gall [45] Certificate Issued Apr. 2, 1991

[54] MATERIAL MIXER

[75] Inventor: John C. Gall, Chicago, Ill.

[73] Assignee: Sears, Roebuck and Co., Chicago, Ill.

Reexamination Request:
No. 90/001,458, Mar. 4, 1988
No. 90/001,542, Jun. 28, 1988

Reexamination Certificate for:

| | |
|---|---|
| Patent No.: | **4,235,553** |
| Issued: | **Nov. 25, 1980** |
| Appl. No.: | **58,034** |
| Filed: | **Jul. 16, 1979** |

Related U.S. Application Data

[63] Continuation-in-part of Ser. No. 945,544, Sep. 25, 1978, abandoned.

[51] Int. Cl.[5] ..... B01F 9/00
[52] U.S. Cl. ..... 366/208
[58] Field of Search ..... 366/213, 217, 216, 208; 134/119, 150; 68/171

[56] References Cited

U.S. PATENT DOCUMENTS

| | | | |
|---|---|---|---|
| 1,519,475 | 12/1924 | Altorfer | 366/216 X |
| 1,554,617 | 9/1925 | Aue | 134/150 |
| 1,755,763 | 4/1930 | Barber | 366/213 X |
| 1,913,979 | 6/1933 | Farrington . | |
| 2,021,209 | 11/1935 | Taccogna . | |
| 2,507,522 | 5/1950 | Heine . | |
| 2,551,206 | 5/1951 | Dickinson . | |
| 3,090,604 | 5/1963 | Wheeler . | |
| 3,374,584 | 3/1968 | Haught . | |
| 3,706,443 | 12/1972 | Oberhauser . | |
| 4,134,689 | 1/1979 | Ahrenskou-Sorensen | 366/110 |
| 4,146,335 | 3/1979 | Hutchings et al. | 366/217 |
| 4,199,268 | 4/1980 | Parzych | 366/306 |

*Primary Examiner*—Timothy F. Simone

[57] ABSTRACT

A mixer for mixing flowable material in a container rotates the material continuously in one direction about a first axis and simultaneously about a second axis which is non-perpendicular to the first axis, the first axis rotating about the second axis. The mixer has means for supporting the container and for rotating the container simultaneously about the two axes. Desirable top to bottom circulation of material within the container is attained by the mixer of the present invention, while the apparatus is simplified and provides economies due to its lower speed and unidirectional, continuous rotational operation.

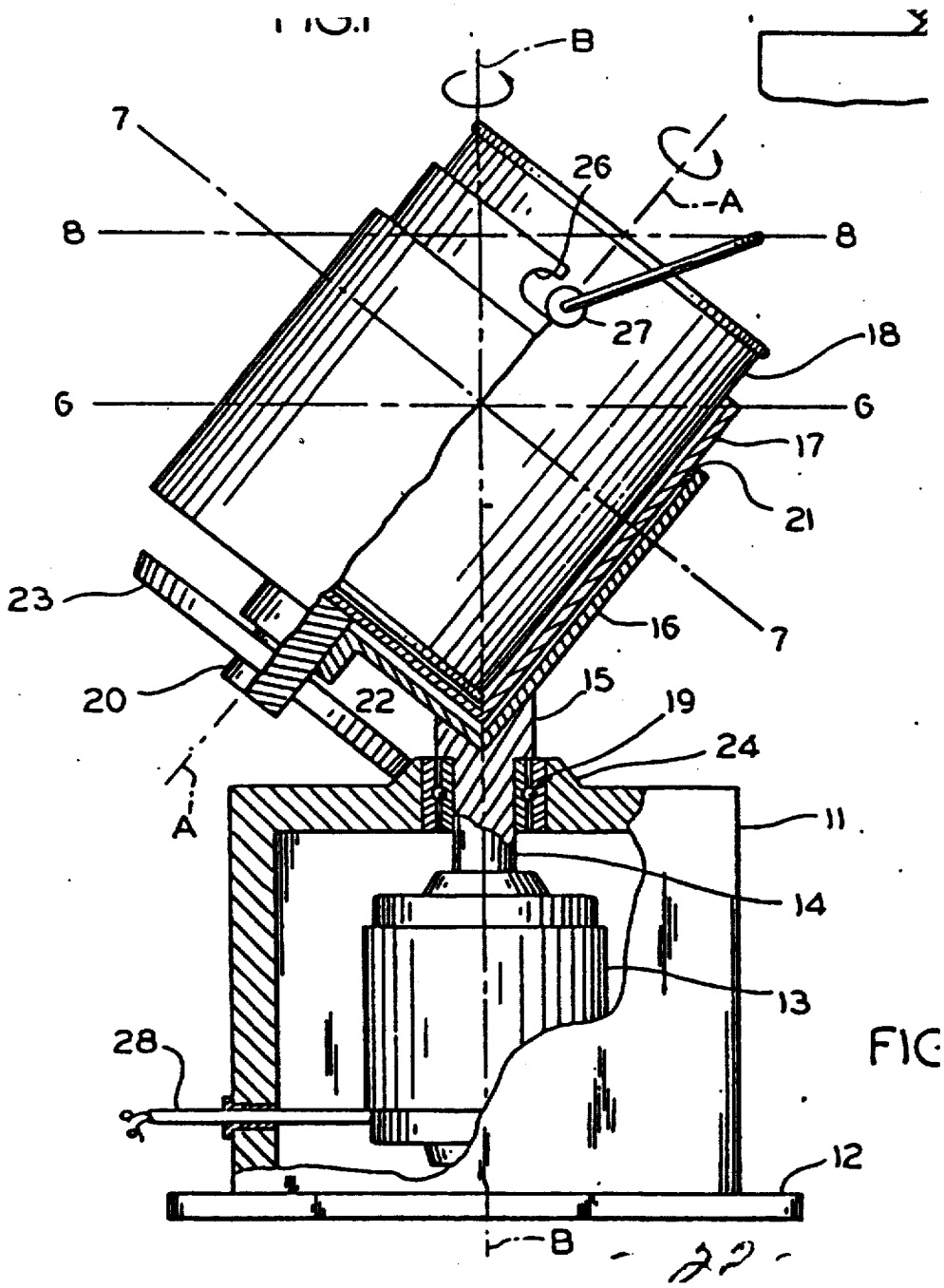
FIG

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-6 are cancelled.

Claim 7 is determined to be patentable as amended.

Claims 8-10, dependent on an amended claim, are determined to be patentable.

New claims 11-29 are added and determined to be patentable.

7. A method of mixing at least partially flowable material *wherein said at least partially flowable material is paint* in a container comprising continuously, non-orbitally rotating the container in one direction about a first axis and simultaneously rotating the container in the same direction about a second axis which is non-perpendicular to the first axis, said first axis non-orbitally rotating about said second axis.

*11. Apparatus for mixing flowable material wherein said flowable material is paint within a container comprising:*

*first supporting means for supporting the container for rotation in one direction about a first axis;*

*second supporting means for supporting the container for rotation in said one direction about a second axis which is non-perpendicular to the first axis;*

*first drive means connected to said second supporting means for rotating the container in said one direction about said second axis; and*

*second drive means connected to said first supporting means for rotating the container in said one direction about said first axis while the container rotates about said second axis;*

*said second supporting means further supporting said first supporting means and at least a portion of said second drive means for rotation about said second axis, said second drive means thereby rotating said first supporting means about said second axis and said first and second drive means rotating the respective supporting means in the same direction, the container and said first and second supporting means each being substantially cylindrical and positioned so that the container and said first supporting means are rotated by said second drive means about said first axis, and simultaneously the container and said first and second supporting means are rotated by said first drive means about said second axis.*

*12. Apparatus as defined in claim 11, wherein said flowable material has at least two different constituent components, said container has a generally cylindrical wall, and said first axis is substantially congruent with the axis of the container.*

*13. Apparatus as defined in claim 12, wherein said first drive means causes a first generally elliptical velocity distribution in the flowable material in a uniform elliptical section taken perpendicular to said second axis through the generally cylindrical wall of the container, said first generally elliptical velocity distribution including at least one point of maximum outer velocity $V_1$ in the flowable material adjacent to said generally cylindrical wall of the container at a point generally corresponding to a major axis of said uniform elliptical section and at least one point of minimum outer velocity $V_2$ in the flowable material adjacent to said generally cylindrical wall of the container in spaced relation to said at least one point of maximum outer velocity $V_1$, said velocities $V_1$ and $V_2$ radially increasing from zero at the point of intersection of said uniform elliptical section with said second axis, and said second drive means causes a second generally circular velocity distribution in the flowable material in a uniform circular section taken perpendicular to said first axis through the generally cylindrical wall of the container, said second generally circular velocity distribution including uniform points of maximum outer velocity $V_3$ in the flowable material adjacent to and substantially entirely about said generally cylindrical wall of the container, said velocity $V_3$ radially increasing from zero at the point of intersection of said uniform circular section with said first axis.*

*14. Apparatus as defined in claim 13, wherein said first and second drive means together cause each point in the flowable material to have a velocity which is an instantaneous vectorial sum of first and second velocity components at said point, said first velocity component being produced by said first drive means and said second velocity component being produced by said second drive means, said first and second drive means also together causing an instantaneous composite maximum outer velocity $V_1+V_3$ to occur at coincident points of maximum outer velocity $V_1$ and $V_3$, said first and second drive means further together causing an instantaneous composite outer resulting velocity $V_R=V_2+V_3$ to occur at coincident points of minimum outer velocity $V_2$ in said first generally elliptical velocity distribution and maximum outer velocity $V_3$ in said second generally circular velocity distribution.*

*15. Apparatus as defined in claim 14, wherein said instantaneous composite outer resulting velocity $V_R$ includes a positive component $+V_{RV}$ and a negative component $-V_{RV}$, said positive and negative components $+V_{RV}$ and $-V_{RV}$ being oppositely disposed in said first generally elliptical velocity distribution, said positive and negative components $+V_{RV}$ and $-V_{RV}$ being oppositely directed to extend generally in the direction of said first axis to cause a longitudinally circulating distribution relative to said first axis, said first and second drive means thereby producing a velocity pattern in the flowable material by reason of said vectorial sums of said first and second velocity components at all points in the flowable material to cause a shear between the different constituent components in the flowable material to achieve mixing in a smooth and continuous manner without violent agitation.*

*16. Apparatus as defined in claim 11, wherein said first axis precesses said second axis.*

*17. Apparatus for mixing flowable material wherein said flowable material is paint within a container comprising:*

*first supporting means for supporting the container for rotation in one direction about a first axis;*

*second supporting means for supporting the container for rotation in said one direction about a second axis which is non-perpendicular to the first axis;*

*first drive means connected to said second supporting means for rotating the container in said one direction about said second axis; and*

*second drive means connected to said first supporting means for rotating the container in said one direction about said first axis while the container rotates about said second axis;*

*said first and second supporting means each being substantially cylindrical and said first drive means including a first shaft which is affixed to and supports said second supporting means for rotation of said first and second supporting means about their respective axes.*

*18. Apparatus as defined in claim 17 wherein said first shaft rotates within a non-rotating member and said second drive means includes a second shaft journalled in said second supporting means and connected to said first supporting means and to rotational means which engages said non-rotating member for rotating said second shaft and said first supporting means, whereby rotation of said first shaft by said first drive means causes rotation of said first and second supporting means about said second axis and simultaneously causes rotation of said first supporting means about said first axis through said second shaft being rotated by said rotational means rolling about said first shaft while in contact with said non-rotating member.*

*19. A method of mixing flowable material wherein said flowable material is paint within a container comprising:*

*supporting the container for rotation in one direction about a first axis;*

*supporting the container for rotation in said one direction about a second axis which is non-perpendicular to the first axis;*

*rotating the container in said one direction about said second axis; and*

*rotating the container in said one direction about said first axis while the container rotates about said second axis.*

*20. The method as defined in claim 19 wherein said first axis precesses said second axis.*

*21. The method as defined in claim 19 wherein said second axis intersects successive points of intersection of the bottom and generally cylindrical side of the container of at least partially flowable material, so that the material is rotated about said axis passing through said intersection.*

*22. The method as defined in claim 19 wherein said first axis is substantially congruent with the axis of the container which is generally cylindrical, so that the material is rotated about said axis passing through the axis of the container.*

*23. The method as defined in claim 19 wherein said flowable material has at least two different constituent components, said container has a generally cylindrical wall, and said first axis is substantially congruent with the axis of the container.*

*24. The method as defined in claim 23 wherein rotating the container in said one direction about said second axis causes a first generally elliptical velocity distribution in the flowable material in a uniform elliptical section taken perpendicular to said second axis through the generally cylindrical wall of the container, said first generally elliptical velocity distribution including at least one point of maximum outer velocity $V_1$ in the flowable material adjacent to said generally cylindrical wall of the container at a point generally corresponding to a major axis of said uniform elliptical section and at least one point of minimum outer velocity $V_2$ in the flowable material adjacent to said generally cylindrical wall of the container in spaced relation to said at least one point of maximum outer velocity $V_1$, said velocities $V_1$ and $V_2$ radially increasing from zero at the point of intersection of said uniform elliptical section with said second axis, and rotating the container in said one direction about said first axis causes a second generally circular velocity distribution in the flowable material in a uniform circular section taken perpendicular to said first axis through the generally cylindrical wall of the container, said second generally circular velocity distribution including uniform points of maximum outer velocity $V_3$ in the flowable material adjacent to and substantially entirely about said generally cylindrical wall of the container, said velocity $V_3$ radially increasing from zero at the point of intersection of said uniform circular section with said first axis.*

*25. The method as defined in claim 24 wherein said rotation about said first and second axes together causes each point in the flowable material to have a velocity which is an instantaneous vectorial sum of first and second velocity components at said point, said first velocity component being produced by rotating the container about said second axis and said second velocity component being produced by rotating the container about said first axis, said rotating of the container about said first and second axes also together causing an instantaneous composite maximum outer velocity $V_1+V_3$ to occur at coincident points of maximum outer velocity $V_1$ and $V_3$, said rotating of the container about said first and second axes further together causing an instantaneous outer resulting velocity $V_R=V_2+V_3$ to occur at coincident points of minimum outer velocity $V_2$ in said first generally elliptical velocity distribution and maximum outer velocity $V_3$ in said second generally circular velocity distribution.*

*26. The method as defined in claim 25 wherein said instantaneous composite outer resulting velocity $V_R$ includes a positive component $+V_{RV}$ and a negative component $-V_{RV}$, said positive and negative components $+V_{RV}$ and $-V_{RV}$ being oppositely disposed in said first generally elliptical velocity distribution, said positive and negative components $+V_{RV}$ and $-V_{RV}$ being oppositely directed to extend generally in the direction of said first axis to cause a longitudinally circulating distribution relative to said first axis, said rotation about said first and second axes thereby producing a velocity pattern in the flowable material by reason of said vectorial sums of said first and second velocity components at all points in the flowable material to cause a shear between the different constituent components in the flowable material to achieve mixing in a smooth and continuous manner without violent agitation.*

*27. Apparatus for mixing flowable material having at least two different constituent components within a container having a generally cylindrical wall, comprising:*

*first supporting means for supporting the container for rotation in one direction about a first axis;*

*second supporting means for supporting the container for rotation in said one direction about a second axis;*

*said first axis being substantially congruent with the axis of the container and said second axis being non-perpendicular to said first axis;*

*first drive means connected to said second supporting means for rotating the container in said one direction about said second axis;*

*second drive means connected to said first supporting means for rotating the container in said one direction about said first axis;*

*said second supporting means further supporting said first supporting means and at least a portion of said second drive means for rotation about said second axis*

*whereby said second drive means rotates said first supporting means about said second axis and said first and second drive means rotate the respective supporting means in the same direction, said first and second supporting means also each being substantially cylindrical and positioned so that the container and said first supporting means are rotated by said second drive means about said first axis and simultaneously the container and said first and second supporting means are rotated by said first drive means about said second axis;*

*said first and second drive means thereby causing a shear between the different constituent components in the flowable material to achieve mixing in a smooth and continuous manner without violent agitation.*

*28. Apparatus for mixing a flowable material having at least two different constituent components within a container having a generally cylindrical wall, comprising:*

*first supporting means for supporting the container for rotation in one direction about a first axis;*

*second supporting means for supporting the container for rotation in said one direction about a second axis;*

*said first axis being substantially congruent with the axis of the container and said second axis being non-perpendicular to said first axis;*

*first drive means connected to said second supporting means for rotating the container in said one direction about said second axis;*

*second drive means connected to said first supporting means for rotating the container in said one direction about said first axis;*

*said first and second supporting means each being substantially cylindrical and said first drive means including a first shaft which is affixed to and supports said second supporting means for rotation of said first and second supporting means about their respective axes;*

*said first and second drive means thereby causing a shear between the different constituent components in the flowable material to achieve mixing in a smooth and continuous manner without violent agitation.*

*29. The apparatus as defined in claim 28 wherein said first shaft rotates within a non-rotating member and said second drive means includes a second shaft journalled in said second supporting means and connected to said first supporting means and to rotational means which engages said non-rotating member for rotating said second shaft and said first supporting means, whereby rotation of said first shaft by said first drive means causes rotation of said first and second supporting means about said second axis and simultaneously causes rotation of said first supporting means about said first axis through said second shaft being rotated by said rotational means rolling about said first shaft while in contact with said non-rotating member.*

* * * * *